US007486183B2

(12) United States Patent
Luebke et al.

(10) Patent No.: US 7,486,183 B2
(45) Date of Patent: Feb. 3, 2009

(54) HOME SYSTEM AND METHOD FOR SENDING AND DISPLAYING DIGITAL IMAGES

(75) Inventors: Charles J. Luebke, Sussex, WI (US); Russ C. Sabo, Sewickley, PA (US); William C. Sabram, Lynn, MA (US); Joseph M. Ballay, Atlanta, GA (US); Michael L. McManus, Oakdale, PA (US)

(73) Assignee: Eaton Corporation, Cleveland, OH (US)

( * ) Notice: Subject to any disclaimer, the term of this patent is extended or adjusted under 35 U.S.C. 154(b) by 830 days.

(21) Appl. No.: 10/852,405

(22) Filed: May 24, 2004

(65) Prior Publication Data

US 2005/0262519 A1 Nov. 24, 2005

(51) Int. Cl.
*G08B 1/08* (2006.01)

(52) U.S. Cl. ..... 340/506; 340/825.36; 340/517; 340/521; 340/539.25; 340/539.26; 340/825.49

(58) Field of Classification Search ..... 340/506, 340/517, 521, 539.25, 539.26, 825.36, 825.49, 340/825.26

See application file for complete search history.

(56) References Cited

U.S. PATENT DOCUMENTS

| | | | | |
|---|---|---|---|---|
| 5,987,011 | A | 11/1999 | Toh | |
| 6,034,961 | A | 3/2000 | Masuo et al. | |
| 6,167,025 | A | 12/2000 | Hsing et al. | |
| 6,385,772 | B1 | 5/2002 | Courtney | |
| 6,542,076 | B1 * | 4/2003 | Joao | 340/539.14 |
| 6,583,720 | B1 | 6/2003 | Quigley | |
| 2002/0057342 | A1 | 5/2002 | Yoshiyama et al. | |
| 2003/0038879 | A1 | 2/2003 | Rye et al. | |
| 2003/0065407 | A1 | 4/2003 | Johnson et al. | |
| 2003/0174210 | A1 | 9/2003 | Vimpari et al. | |
| 2004/0047471 | A1 | 3/2004 | Sawano | |

FOREIGN PATENT DOCUMENTS

DE 10035812 A1 1/2002

(Continued)

OTHER PUBLICATIONS

Johnson, David B., et al., "Dynamic Source Routing in Ad Hoc Wireless Networks", Mobile Computing, 1996, 18 pp.

(Continued)

*Primary Examiner*—Daryl C Pope
(74) *Attorney, Agent, or Firm*—Charles E. Kosinski

(57) ABSTRACT

A home wellness system includes a base station having a wireless communication port, a telephone communication port and a memory with a plurality of digital images. The system also includes a plurality of network devices, with at least one of the network devices having a sensor adapted to detect an event, and a wireless communication port adapted to send the detected event to the wireless communication port of the base station. Another device, such as a cellular telephone, includes a telephone communication port and a display. The telephone communication port of the base station is adapted to send one of the digital images to the telephone communication port of the cellular telephone responsive to receipt of the detected event at the wireless communication port of the base station. The cellular telephone is adapted to responsively display the one of the digital images on the display thereof.

25 Claims, 12 Drawing Sheets

FOREIGN PATENT DOCUMENTS

| | | | |
|---|---|---|---|
| EP | 1316933 | A | 6/2003 |
| GB | 2325548 | A | 11/1998 |
| WO | WO 97/07486 | A | 2/1997 |

OTHER PUBLICATIONS

Chipcon, "CC1010 Product Information", http://www.chipcon.com/index.cfm?kat_id=2&subkat_id=12&dok_id=55, Oct. 6, 2003, 2 pp.

SearchSecurity.com, "key fob," http://searchsecurity.techtarget.com/sDefinition/0,,sid14_gci795968.00.html, Sep. 22, 2003, 2 pp.

GE Industrial Systems, "Electronic House Magazine Names Smart ConnectionCenter and NetworX NX-8E Product of the Year", Aug. 12, 2003, 2 pp.

GE Industrial Systems, "GE Interlogix Releases The Concord Ultra Security System", Sep. 2, 2003, 2 pp.

Ben Berkowitz, "Plain Old Cell Phones Fading Away in U.S.", http://story.news.yahoo.com/news?tmpl=story&cid=569&e=7&u=/nm/bizcellphones_dc, Feb. 12, 2004, 3 pp.

* cited by examiner

NETWORK DEVICE
148,150,152
BASE_PIC
122
BASE_RF
126
FOB_RF
188
FOB_PIC
184
258
299
DATA(data)
Acknowledgement(SUCCESS)
300
298
PICDATA_request(data)
PICDATA_confirm(SENT)
302
297
256

HOME SYSTEM AND METHOD FOR SENDING AND DISPLAYING DIGITAL IMAGES

CROSS-REFERENCE TO RELATED APPLICATIONS

This application is related to commonly assigned:

U.S. patent application Ser. No. 10/686,187, filed Oct. 15, 2003, entitled "Home System Including A Portable Fob Having A Display";

U.S. patent application Ser. No. 10/686,179, filed Oct. 15, 2003, entitled "Home System Including A Portable Fob Having A Rotary Menu And A Display"; and U.S. patent application Ser. No. 10/686,016, filed Oct. 15, 2003, entitled "Home System Including A Portable Fob Mating With System Components".

BACKGROUND OF THE INVENTION

1. Field of the Invention

This invention relates generally to home systems and, more particularly, to home systems employing sensors and communications, such as, for example, a wireless local area network (WLAN) or a low rate—wireless personal area network (LR-WPAN). The invention also relates to methods for detecting and monitoring events in a home system.

2. Background Information

Home security or "wellness" monitoring systems provide remote status and/or alarm information through telephone voice or paging technology. Such status or information includes prerecorded voice or text messages.

Standalone digital cameras, cellular telephones with a camera, and cellular telephones with a display are known.

There is room for improvement in home systems, and in methods and apparatus for detecting and monitoring events in such systems.

SUMMARY OF THE INVENTION

It is believed that it is not known to send a digital image from a home monitoring system to a cellular data (display) telephone.

The present invention sends one or more digital images (e.g., a predetermined digital image; a digital image at the time of an event) to a remote device, such as a cellular telephone display, in order to provide improved remote indication of a status, a status change and/or a problem as identified by a home system.

As one aspect of the invention, a home system comprises: a server including a first communication port, a second communication port and a memory having at least one digital image; a plurality of first devices, at least one of the first devices comprising a sensor adapted to detect an event, and a first communication port adapted to send the detected event to the first communication port of the server; and a second device including a second communication port and a display, wherein the second communication port of the server is adapted to send one of the at least one digital image to the second communication port of the second device responsive to receipt of the detected event at the first communication port of the server, and wherein the second device is adapted to display the one of the at least one digital image on the display responsive to receipt thereof at the second communication port of the second device.

The one of the at least one digital image may be a predetermined digital image in the memory of the server. The server may be adapted to receive a message from the at least one of the first devices as the detected event and to associate the message with the predetermined digital image.

The server may be adapted to receive a message and a corresponding digital image from the at least one of the first devices at the first communication port of the server, and to store the corresponding digital image as the one of the at least one digital image in the memory of the server.

The second device may be adapted to send a request message from the second communication port thereof to the second communication port of the server. The server may be adapted to receive the request message from the second communication port thereof and to send another request message to the first communication port of the at least one of the first devices. The at least one of the first devices may be a digital camera device comprising the sensor, which is adapted to detect receipt of the another request message as the event, a digital camera adapted to create a corresponding digital image responsive to the event, and the first communication port of the at least one of the first devices being adapted to send the corresponding digital image as the detected event to the first communication port of the server. The server may be adapted to stored the corresponding digital image in the memory of the server and to send the corresponding digital image from the second communication port thereof to the second communication port of the second device. The second device may be adapted to display the corresponding digital image on the display responsive to receipt thereof at the second communication port of the second device.

The one of the at least one digital image may be a predetermined digital image in the memory of the server prior to receipt of the detected event at the first communication port of the server.

The one of the at least one digital image may be communicated to the first communication port of the server with the detected event.

The at least one of the first devices may further include a digital camera operatively associated with the sensor. The sensor may be adapted to detect the event and responsively trigger the digital camera. The digital camera, responsive to the trigger, may be adapted to create a digital image and communicate the created digital image to the first communication port of the server with the detected event.

Another one of the first devices may be a digital camera including a corresponding first communication port. The sensor may be adapted to detect the event and responsively send the detected event to the first communication port of the server. The server may be adapted to receive the detected event and send a snapshot request to the corresponding first communication port of the digital camera. The digital camera, responsive to receiving the snapshot request, may be adapted to create a digital image and communicate the created digital image to the first communication port of the server.

The sensor may be a first sensor, the event may be a first event, the digital image may be a first digital image, another one of the first devices may be a second sensor including a corresponding first communication port, and a further one of the first devices may be a digital camera including a corresponding first communication port. The second sensor may be adapted to detect a second event and responsively send the detected second event to the first communication port of the server. The server may be adapted to receive the detected second event and send a snapshot request to the corresponding first communication port of the digital camera. The digital camera, responsive to receiving the snapshot request, may be adapted to create a second digital image and communicate the created digital image to the first communication port of the server.

The at least one of the first devices may further include a plurality of digital cameras operatively associated with the sensor. The sensor may be adapted to detect the event and responsively trigger the digital cameras. Each of the digital cameras, responsive to the trigger, may be adapted to create a corresponding digital image and to communicate the corresponding digital image to the first communication port of the server. The server may be adapted to receive each of the corresponding digital images at the first communication port of the server, and to store the corresponding digital images in the memory of the server.

As another aspect of the invention, a method of displaying a digital image responsive to an event of a home system comprises: employing a home system server including a memory having at least one digital image; employing a plurality of first devices associated with the home system server; detecting an event at one of the first devices and sending the detected event to the home system server; responsively sending one of the at least one digital image to a second device; and responsively displaying the one of the at least one digital image on a display of the second device, in order to represent the detected event.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
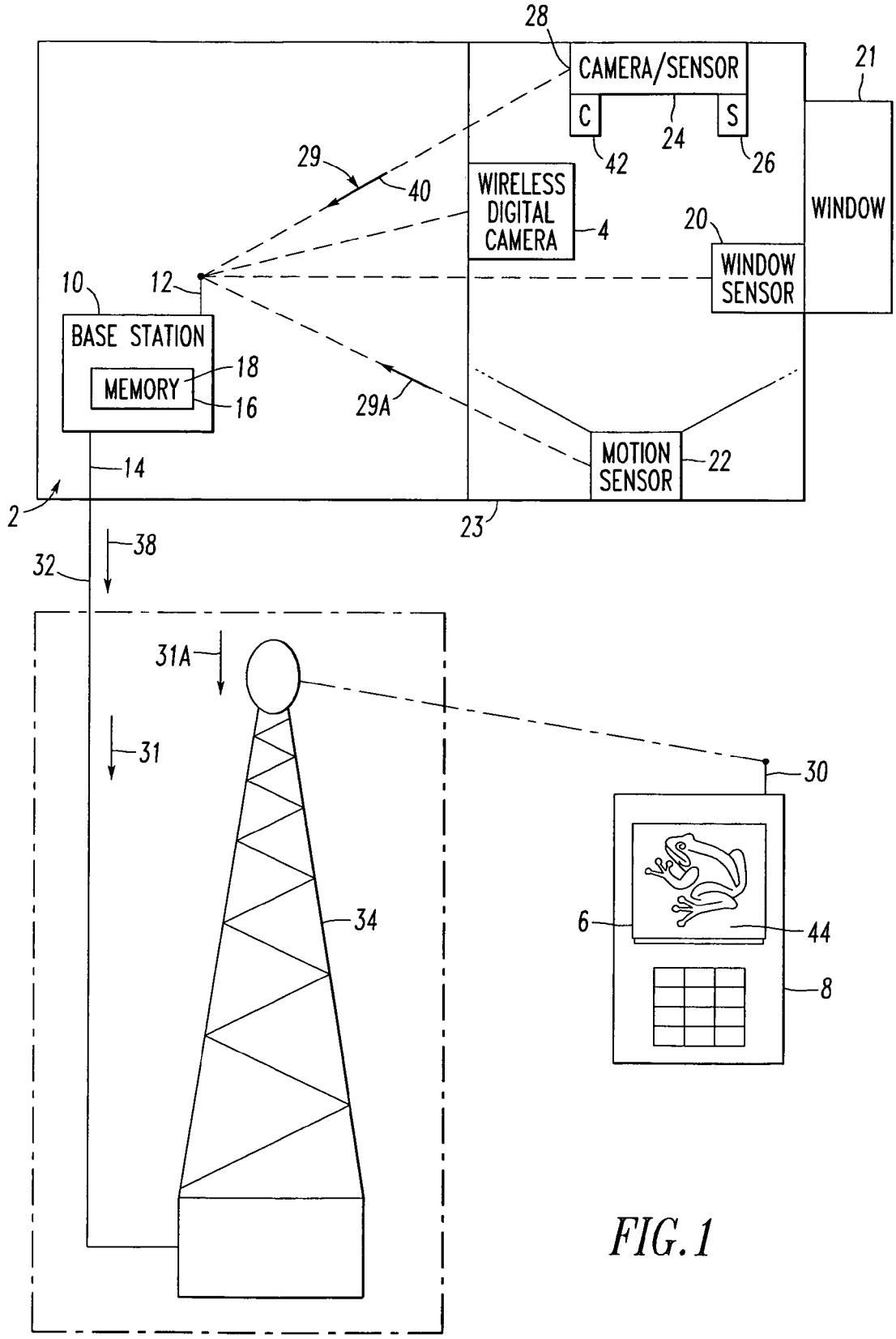
FIG. 1 is a block diagram of a home monitoring system including a base station, a wireless digital camera, a plurality of sensors and a remote display of a cellular telephone.

As employed herein, the term "wireless" shall expressly include, but not be limited by, radio frequency (RF), infrared, wireless area networks, IEEE 802.11 (e.g., 802.11a; 802.11b; 802.11g), IEEE 802.15 (e.g., 802.15.1; 802.15.3, 802.15.4), other wireless communication standards, DECT, PWT, pager, PCS, Wi-Fi, Bluetooth™, and cellular.

As employed herein, the term "communication network" shall expressly include, but not be limited by, any local area network (LAN), wide area network (WAN), intranet, extranet, global communication network, the Internet, and/or wireless communication network.

As employed herein, the term "portable wireless communicating device" shall expressly include, but not be limited by, any portable communicating device having a wireless communication port (e.g., a portable wireless device; a portable personal computer (PC); a Personal Digital Assistant (PDA)), data phone.

As employed herein, the term "fob" shall expressly include, but not be limited by, a portable wireless communicating device; a wireless network device; an object that is directly or indirectly carried by a person; an object that is worn by a person; an object that is placed on or coupled to a household object (e.g., a refrigerator; a table); an object that is coupled to or carried by a personal object (e.g., a purse; a wallet; a credit card case); a portable object; and/or a hand-held object.

As employed herein, the term "user input device" shall expressly include, but not be limited by, any suitable input mechanism or transducer, which collects user input through direct physical manipulation, with or without employing any moving part(s), and which converts such input, either directly or indirectly through an associated processor and/or converter, into a corresponding digital form.

As employed herein, the term "network coordinator" (NC) shall expressly include, but not be limited by, any communicating device, which operates as the coordinator for devices wanting to join a communication network and/or as a central controller in a wireless communication network.

As employed herein, the term "network device" (ND) shall expressly include, but not be limited by, any communicating device (e.g., a portable wireless communicating device; a fob; a camera/sensor device; a wireless camera; and/or a fixed wireless communicating device, such as, for example, switch sensors, motion sensors or temperature sensors as employed in a wirelessly enabled sensor network), which participates in a wireless communication network, and which is not a network coordinator.

As employed herein, the term "node" includes NDs and NCs.

As employed herein, the term "headless" means without any user input device and without any display device.

As employed herein, the term "server" shall expressly include, but not be limited by, a "headless" base station; and/or a network coordinator.

As employed herein, the term "residence" shall expressly include, but not be limited by, a home, apartment, dwelling, office and/or place where a person or persons reside(s) and/or work(s).

As employed herein, the term "home system" shall expressly include, but not be limited by, a system for a home or other type of residence.

As employed herein, the term "digital image" shall expressly include, but not be limited by, a digital picture; a digital photograph; an image created by digital camera; and/or a digital representation of a picture, photograph, object, person or thing.

As employed herein, the term "cellular telephone" shall expressly include, but not be limited-by, wireless telephones; data phones with a digital display; and/or mobile telephones.

As employed herein, a home wellness system shall expressly include, but not be limited by, a home system for monitoring and/or configuring aspects of a home or other type of residence.

Referring to FIG. 1, a home monitoring system 2 includes a digital camera, such as a wireless digital camera 4, and a remote display 6 of another device, such as a cellular telephone 8. The system 2 further includes a server, such as base station 10, having a first communication port 12, a second communication port 14, and a memory 16 with one or more digital images 18. The system 2 also includes a plurality of network devices, such as, for example, window sensor 20 for window 21, motion sensor 22 for detecting movement in area 23, and a camera/sensor 24. The various network devices 20,22,24, as shown with the camera/sensor 24, include a sensor (S) 26 adapted to detect a corresponding event (e.g., movement in the area 23) and a communication port 28 adapted to send the detected event as a wireless message 29 to the server first communication port 12.

The example cellular telephone 8 includes a communication port, such as an antenna 30, and the display 6. The server second communication port 14 is adapted to send a corresponding digital image 31 of the one or more digital images 18 to the cellular telephone communication port 30 responsive to receipt of the wireless message 29 at the server first communication port 12. In response, the cellular telephone 8 is adapted to display the corresponding digital image 31 on the display 6 responsive to receipt thereof at the cellular telephone communication port 30.

EXAMPLE 1

The base station 10 sends the digital image 31 from its second communication port 14 on telephone line 32 through cell tower 34 to the remote cellular telephone 8. The hardware and messaging for this communication that the base station 10 employs to send the digital image 31 may mimic, for example, a telephone text message employed by a cellular telephone (not shown) including a camera and a display.

For example, on such a cellular telephone (not shown), the user: (1) selects (e.g., from a menu (not shown)), "take picture," which causes the digital image to be captured; (2) presses "send"; (3) selects e-mail (as the type of delivery mechanism); (4) enters the e-mail address of the intended recipient (and optionally adds any text to the message); and (5) presses "send". This causes the cellular telephone to send the e-mail text message with, for example, a ".jpg" picture embedded in the body thereof.

In the present example, the base station 10 includes the digital image 31 (e.g., as obtained from an integral digital camera 218 (FIG. 7); as obtained from an external digital camera 218' (FIG. 8)). First, the base station 10 creates an e-mail message (not shown) with the digital image 31 and any related text (e.g., "Smith House, 1234 N. Main St. <Rear Door Opened>"). Next, the base station 10 employs the second communication interface 14 and calls out to the user's Internet service provider (not shown). Then, the base station 10 sends the e-mail message to the desired cellular telephone 8 (e.g., to 123-456-7890@TMobile.com). When the e-mail message is received at the cellular telephone 8, the user is alerted of a received message. Finally, the user views the message and the digital image 31. Preferably, the cellular telephone 8 "time stamps" when the e-mail message was received rather than have the base station 10 employ a real time clock (not shown).

Alternatively, any suitable delivery mechanism may be employed (e.g., text or picture messages may be sent directly between two cellular telephones and the base station 10 may mimic that delivery mechanism).

EXAMPLE 2

The one or more digital images 18 may be digital images captured during the setup of the sensors 20,22,24 of the home monitoring system 2, and/or may be digital images created at the time of corresponding detected events.

EXAMPLE 3

In this example, digital images are captured during setup of the sensors 20,22,24 of the home monitoring system 2. The user may create predetermined digital images (e.g., with digital camera 4) of where each of the sensors 20, 22 are mounted. Then, when the base station 10 sends an alert message 38 to the cellular telephone 8, the display 6 thereof shows a digital image (not shown) of the "activated" sensor in its location. Messages associated with this example are discussed below in connection with FIG. 13.

During operation, whenever a sensor "trips," which indicates that an event has occurred, the base station 10 detects this and responsively transmits the alert message 38 and the corresponding predetermined digital image 31A (e.g., a picture of an open garage door; a picture of a closed garage door) to the cellular telephone 8 for display thereon. Hence, at a glance, the user visually sees the event, instead of merely receiving a text message. In this example, the digital image 31A shows the location of the corresponding sensor and its representative state, rather than the exact image including the condition that caused the event. This allows for at-a-glance awareness with universal appeal and no words.

Here, the digital image 31A is predetermined in the memory 16 of the base station 10, which is adapted to receive a wireless message 29A from the sensors 20,22 as the detected event and to associate the subsequent alert message 38 with the predetermined digital image 31A.

EXAMPLE 4

A wireless digital camera, such as camera/sensor 24, sends a digital image 40 along with the detected event in the wireless message 29. In this example, if the sensor (S) 26 is a motion detector that detects movement in the area 23 (e.g., a "critter" in a garage), a corresponding camera (C) 42 creates the digital image 40 (e.g., a digital picture of a frog in the garage), which is sent to the base station 10 in the wireless message 29. In turn, the base station 10 forwards this digital image 31 to the remote user at the cellular telephone display 8, which shows the image 44 of the frog. For example, the digital image 40 would be sent to the user's cellular telephone 8, in order to provide a visual verification, as might be required by a police department, to respond to an "alarm" call or not to respond to a false alarm.

EXAMPLE 5

One or more wireless digital cameras 4, 42 of the home system 2 send digital images 31,31 A remotely to a user through the base station 10 and the user's cellular telephone 8.

For example, a cellular carrier (not shown) promotes, sells, bills and collects revenue for this feature (e.g., a fixed or variable price per month added to the bill for the cellular telephone 8). Such digital images 31,31A are preferably sent only to the user's cellular telephone 8, which provides a visual verification as may be required by a police department to respond to an "alarm" call. Hence, the digital cameras 4,42 are not viewable by anyone else and are not viewable on the Internet (not shown).

EXAMPLE 6

It will be appreciated that the digital images 31, 31A provide, either, a predetermined visual confirmation of the area of the residence associated with the particular sensor 20,22, or a visual confirmation of the likely cause of the event in the residence. In the latter example, this visual confirmation advantageously communicates to the user the severity of the event (e.g., a garage motion detector has detected a wild animal, a small child, a burglar, or a known adult; a basement water sensor shows a small puddle or a substantial level of water).

EXAMPLE 7

Figure 2:
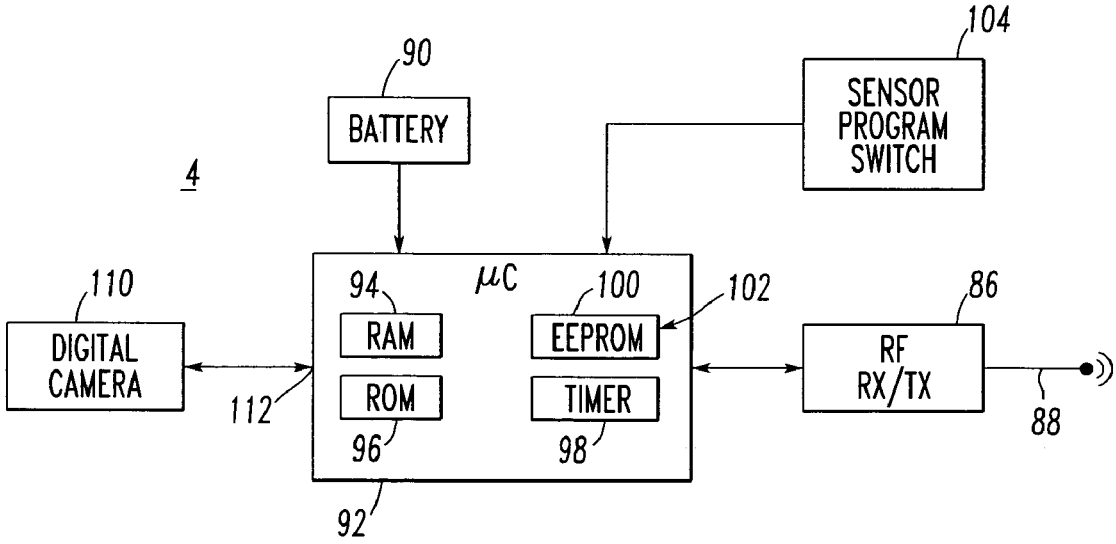
FIG. 2 is a block diagram of the wireless digital camera of FIG. 1.
Figure 3:
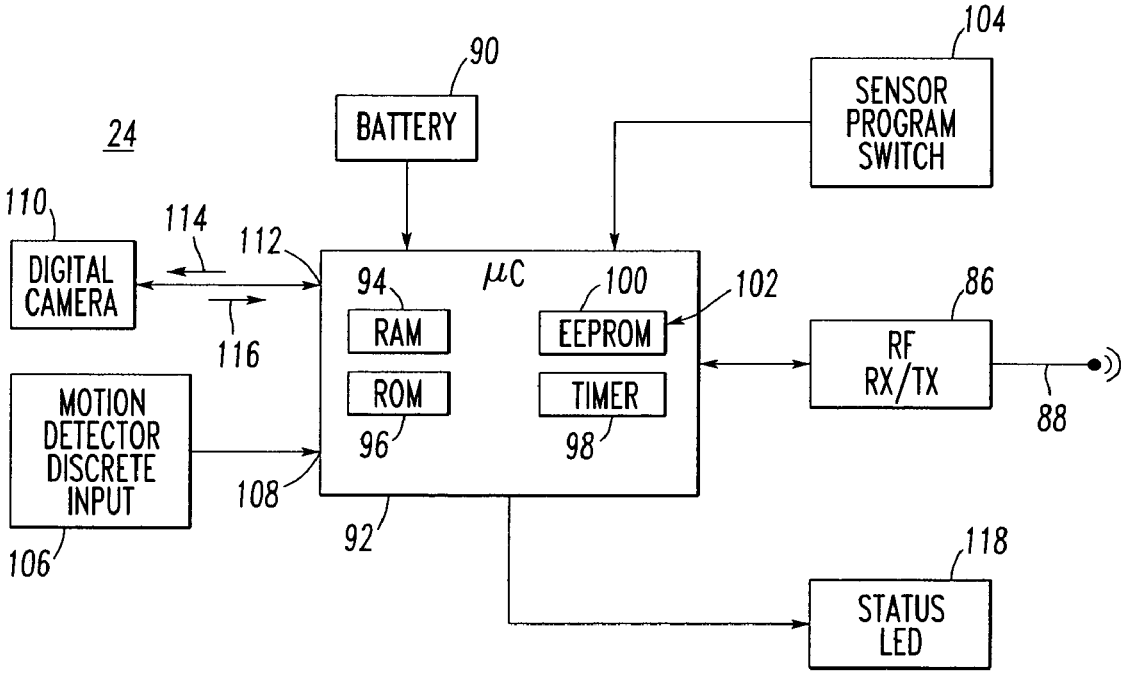
FIG. 3 is a block diagram of the wireless digital camera/sensor of FIG. 1.

FIGS. 2 and 3 are block diagrams of the wireless digital camera 4 and the wireless digital camera/sensor 24, respectively, of FIG. 1. The camera 4 and the camera/sensor 24 include an RF transceiver (RF RX/TX) 86 having an external antenna 88, a battery 90 or other suitable power source for powering the various sensor components, a suitable processor, such as a microcontroller (μC) 92 having RAM 94, ROM 96, a timer 98 (e.g., in order to provide, for example, a periodic wake-up of the μC 92, in order to periodically send sensor status information back to the base station 10 of FIG. 1) and other memory (e.g., EEPROM 100 including the unique ID 102 of the component which is stored therein during manufacturing), and a sensor program switch 104 for mating with the fob program switch 174 of FIG. 6. The camera 4 and the camera/sensor 24 further include a digital camera 110 having a suitable interface 112 (e.g., logic level; USB; parallel; serial) to the μC 92.

EXAMPLE 8

The camera/sensor 24 further includes a physical discrete input 106 (e.g., an on/off detector; an open/closed detector; a water detector; a motion detector) with the μC 92 employing a corresponding discrete input 108. In this example, the discrete input 106 is a motion detector adapted to detect motion as the event. In the camera/sensor 24, the digital camera 110 is operatively associated with the motion detector input 106, which is adapted to detect the event (e.g., motion in this example) and responsively trigger 114 the digital camera 110 through the μC 92. The digital camera 110, responsive to the trigger 114, is adapted to create a digital image 116, which the μC 92 receives and communicates to the communication port 12 of the base station 10 of FIG. 1 with the detected event.

The camera/sensor 24 also includes a suitable indicator, such as an LED 118, to output the status of the physical discrete input 106 (e.g., LED illuminated for on; LED non-illuminated for off). The camera 4 of FIG. 2 does not include an indicator. It will be appreciated, however, that the camera/sensor 24 need not employ an indicator and that the camera 4 may employ an indicator (e.g., to show that the battery 90 is OK).

EXAMPLE 9

Although a motion detector input 106 is disclosed, a wide range of sensors (e.g., door open; window open; garage door open; closet door open; attic door open; unexpected motion; smoke alarm; water detected) may be employed by camera/sensors, such as the camera/sensor 24. Although a battery 90 is shown in FIGS. 2 and 3, that power source may be replaced by or supplemented by a suitable AC/DC power source (not shown), in order to conserve battery power or to avoid the need for battery replacement.

EXAMPLE 10

During operation, when a sensor, such as camera/sensor 24, detects that an event has occurred, it transmits the wireless message 29 (FIG. 1) as an alert message to the base station first communication port 12 (FIG. 1). In this example, a digital camera, such as 110 of FIG. 3, is physically paired with the corresponding sensor, such as the motion detector input 106 of FIG. 3. After the motion detector input 106 detects a corresponding event, the digital camera 110 creates the corresponding digital image 116, and the camera/sensor 24 transmits the corresponding alert and the corresponding digital image 116 in the wireless message 29 to the base station 10. Finally, the base station 10 transmits the alert message 38 and the digital image 31 through its second communication port 14 (FIG. 1) to the cellular telephone 8 (FIG. 1) for display on the display 6 of that digital picture-enabled display device.

For example, a front door motion detector (not shown) may detect that someone or something is at the front door (not shown) and may, thus, provide a digital image of that person or thing.

One advantage of physical pairing is that it requires no special user setup of the camera/sensor 24.

EXAMPLE 11

Figure 4:
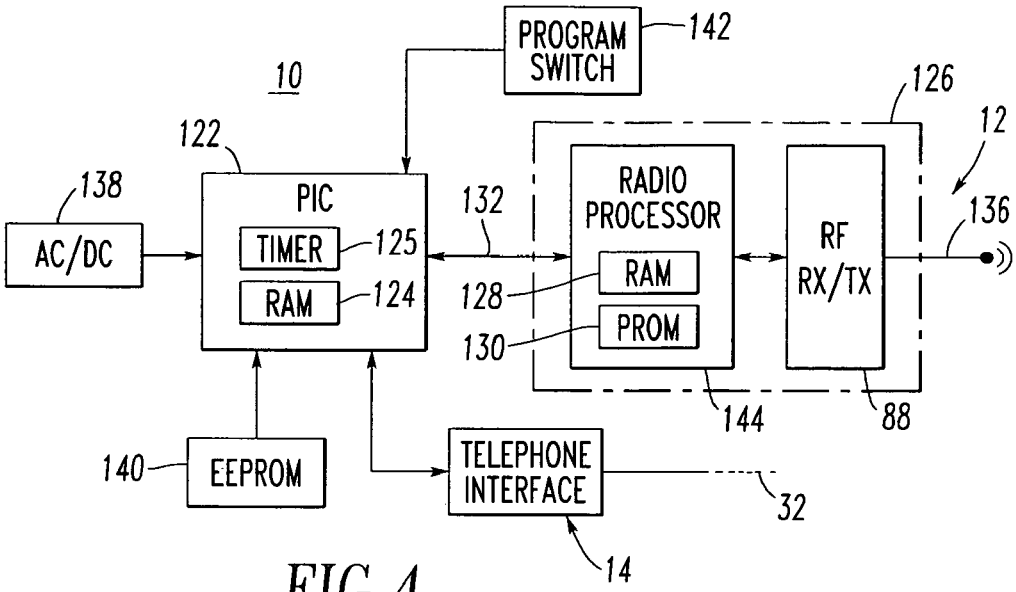
FIG. 4 is a block diagram of the base station of FIG. 1.

FIG. 4 shows the base station 10 of FIG. 1. The base station 10 includes a suitable first processor 122 (e.g. PIC® model 18F2320, marketed by Microchip Technology Inc. of Chandler, Ariz.), having RAM memory 124 and a suitable second radio or RF processor 126 having RAM 128 and PROM 130 memory. The first and second processors 122,126 communicate through a suitable serial interface (e.g., SCI; SPI) 132. The second processor 126, in turn, employs the communication port 88, such as the RF transceiver (RX/TX), having an external antenna 136. As shown with the processor 122, the various base station components receive power from a suitable AC/DC power supply 138. The first processor 122 receives inputs from a timer 125 and a program switch 142 (e.g., which detects mating or engagement with the fob 154 of FIG. 6). The EEPROM memory 140 is employed to store the unique ID of the base station 10 as well as other nonvolatile information such as, for example, the unique IDs of other components, which are part of the wireless network 162 of FIG. 5, and other configuration related information. The second processor 126 may be, for example, a CC1010 RF Transceiver marketed by Chipcon AS of Oslo, Norway. The processor 126 incorporates a suitable microcontroller core 144, the relatively very low-power RF transceiver 88, and hardware DES encryption/decryption (not shown).

EXAMPLE 12

Figure 5:
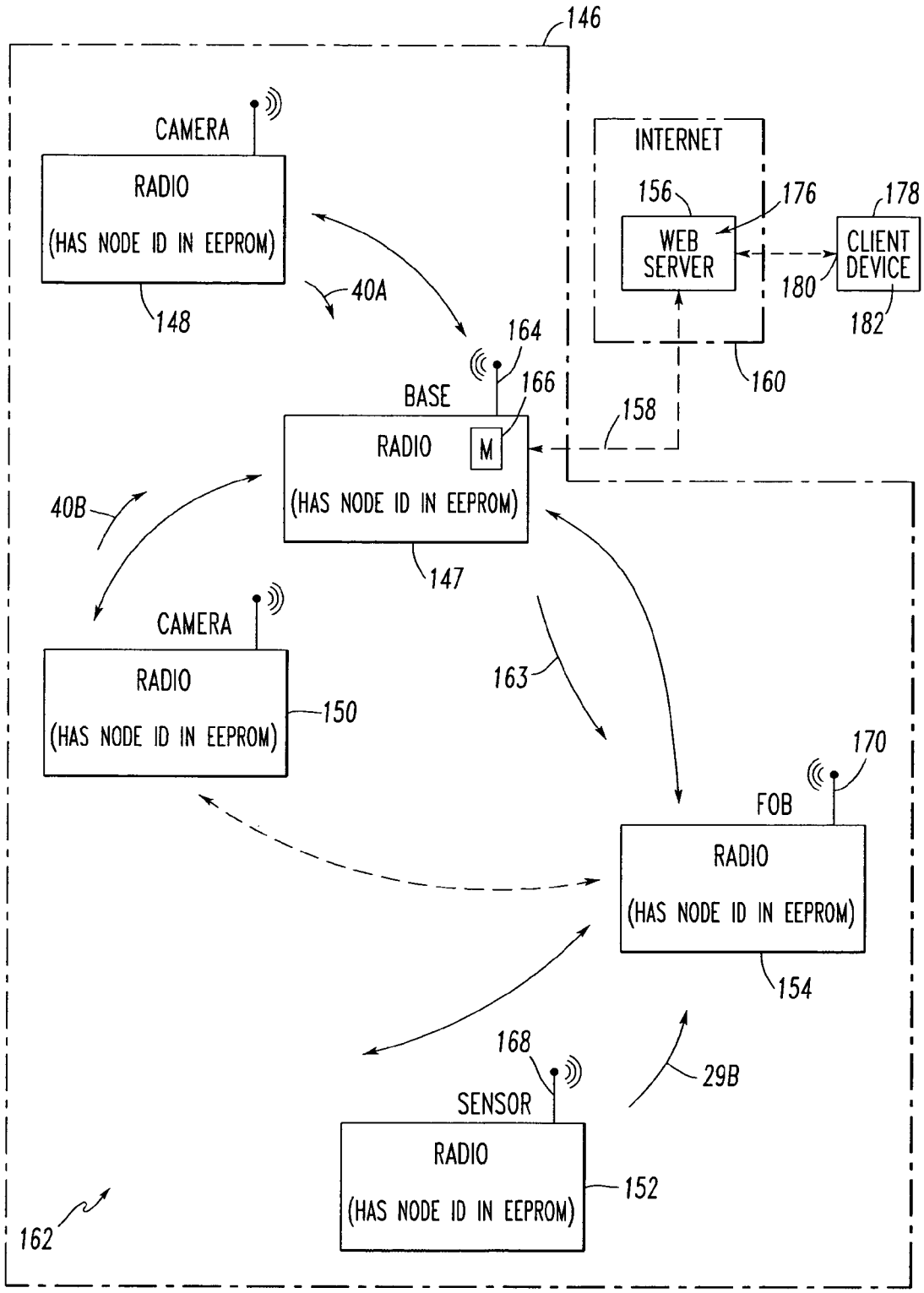
FIG. 5 is a block diagram of another home monitoring system including a base station, a plurality of wireless digital cameras, a sensor and a portable fob, and an Internet web server and client device.

FIG. 5 is a block diagram of another wireless home monitoring system 146 including a base station 147, wireless digital cameras 148,150, a sensor 152, a portable fob 154 and an interface to an Internet web server 156. The system 146 includes the "headless" RF base station 147, the portable RF fob or "house key" 154, and one or more RF sensors, such as 152. The RF base station 147 includes a suitable communication link 158 (e.g., telephone; DSL; Ethernet) to the Internet 160 and, thus, to the web server 156. The sensor 152 may include, for example, an analog sensor (not shown) or an on/off digital detector, such as the sensors 20,22 of FIG. 1. The sensor 152, cameras 148,150, base station 147 and fob 154 all employ relatively short distance, relatively very low power, RF communications. These devices 147,148,150,152, 154 form a wireless network 162 in which the node ID for each of such devices is unique and preferably is stored in a suitable non-volatile memory, such as EEPROM, on each such device.

The base station 147 (e.g., a wireless server; a network coordinator) may collect data from the sensor 152 and cameras 148,150 and "page," or otherwise send an RF alert message 163 to, the fob 154 in the event that a critical status changes at one or more of these network devices 148,150,152.

The fob 154 may be employed as both a portable in-home monitor for the various network devices 148,150,152 and, also, as a portable configuration tool for the base station 147 and such devices.

The example base station 147 is headless and includes no user interface. The network devices 148,150,152 preferably include no user interface, although some sensors may have a status indicator (e.g., LED 118 of FIG. 3). The user interface functions are provided by the fob 154 as will be discussed in greater detail, below, in connection with FIG. 6. As shown with the sensor 152, the network 162 preferably employs an adhoc, multihop capability, in which the network devices 148,150,152 and the fob 154 do not have to be within range of the base station 147, in order to communicate.

EXAMPLE 13

As was discussed above in connection with FIG. 1, the camera 4 may be logically associated with one or more sensors, such as 20 and/or 22. Alternatively, as shown in FIG. 5, one or more cameras, such as 148,150, may be logically associated with one or more sensors, such as 152. For example, the cameras 148,150 may create respective digital images 40A,40B from two different camera angles in response to a single event 29B as determined by the sensor 152.

As will be discussed below in connection with FIG. 11, the sensor 152 is adapted to detect an event and responsively trigger a camera, such as 148 and/or 150. The cameras 148, 150, responsive to the trigger, are adapted to create the corresponding digital image 40A,40B and to communicate the same to the first communication port 164 of the base station 147, which is similar to the base station 10 of FIG. 1. The base station 147, in turn, is adapted to receive each of the corresponding digital images 40A,40B at the communication port 147, and to store the corresponding digital images in the memory (M) 166 of the base station 147.

EXAMPLE 14

Figure 6:
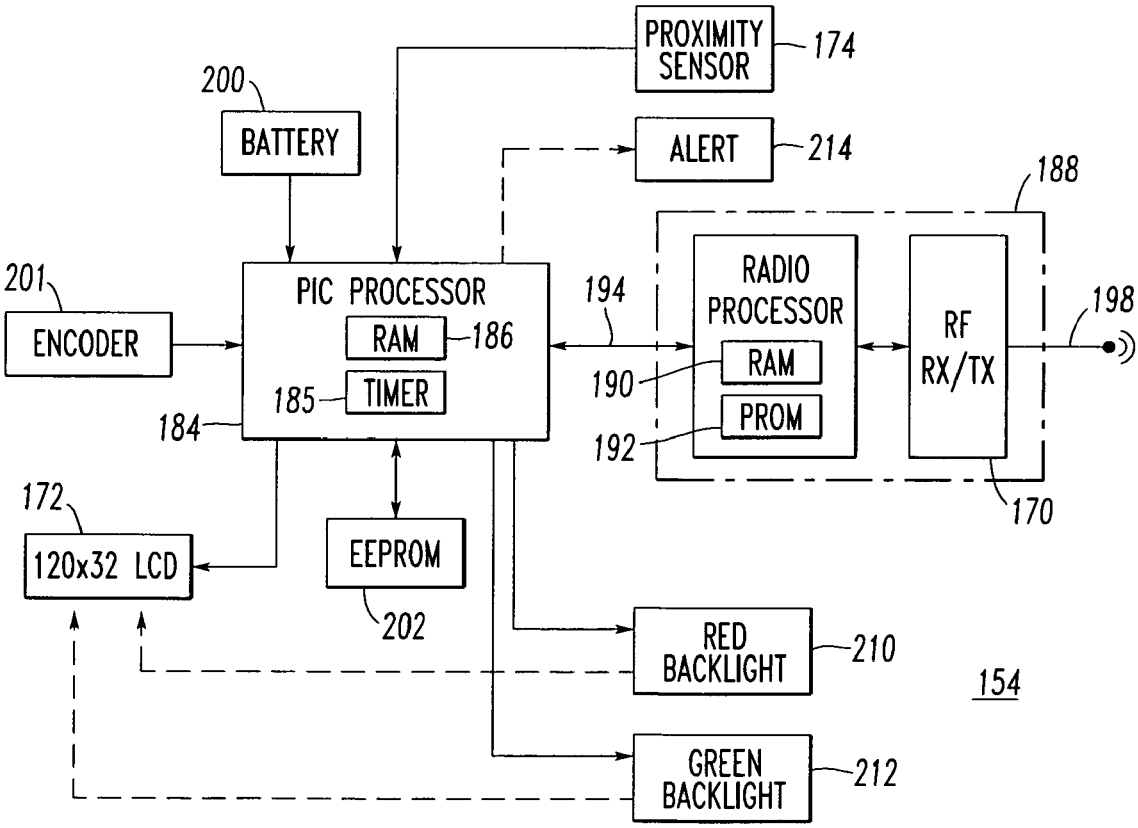
FIG. 6 is a block diagram of the portable fob of FIG. 5.

Each one of the network devices 148,150,152, such as the sensor 152, senses information and includes a corresponding communication port, such as port 168, which sends the sensed information to the first communication port 164 of the base station 147. Another network device, the portable fob 154, includes a corresponding communication port 170 and a display 172 (FIG. 6). The base station 147 is adapted to send the sensed information for one or more the network devices 148,150,152 from the base station first communication port 164 to the communication port 170 of the portable fob 154. The portable fob 154 is adapted to display the sensed information for the more or more network devices 148,150,152 at the portable fob display 172.

EXAMPLE 15

A remote user may employ a web site, such as a secure web site 176 at the web server 156, in order to remotely query the home monitoring system 146 from a client device 178 having a suitable global communication network (e.g., Internet) communication port 180. This may provide additional details to the user that the digital images 31,31A of FIG. 1 might have left out. For example, one or more digital images 40A,40B from one or more cameras 148,150 may be selectively displayed, in order to see the problem(s) and/or the severity thereof, prior to taking any kind of corrective action, such as, for example, calling the police. An example of the corresponding messages is discussed below in connection with FIG. 12.

As shown in FIG. 5, the client device 178 includes an Internet web browser 182. The user may access the Internet 160 through the web browser 182, go to the web site 176, logon with a name and/or password, and request to see the camera views of the home system 146. Then, the web site server 176 accesses the user's base station 147 through the communication link 158 and requests the views of the cameras 148,150, which were requested by an "authorized" user at the client device 178.

EXAMPLE 16

FIG. 6 shows the fob 154 of FIG. 5. The fob 154 includes a suitable first processor 184 (e.g., PIC) having a timer 185 and RAM memory 186, and a suitable second radio or RF processor 188 having RAM 190 and PROM 192 memory. The first and second processors 184,188 communicate through a suitable serial interface (e.g., SCI; SPI) 194. EEPROM memory 202 is employed to store the unique ID of the fob 154 as well as other nonvolatile information. For example, there may be a nonvolatile storage for icons, character/font sets and sensor labels (e.g., the base station 147 of FIG. 5 sends a message indicating that an on/off sensor is ready to configure, and the fob 154 looks up the on/off sensor and finds a predefined list of names to choose from). This expedites a relatively rapid interaction. The fob 154 may also employ a short-term memory cache (not shown) that is used when the fob 154 is out of range of the base station 147. This stores the list of known sensors and their last two states. This permits the user, even if away, to review, for example, what door was open, when the fob 154 was last in range.

The second processor 188, in turn, employs the communication port 170, such as an RF transceiver (RX/TX), having an external antenna 198. As shown with the processor 184, the various components of the fob 154 receive power from a battery 200. The first processor 184 receives inputs from the timer 185, a suitable proximity sensor, such as a sensor/base program switch 174 (e.g., which detects mating or engagement with one of the network devices 148,150,152 or with the base station 147 of FIG. 5), and a user input device, such as, for example, the exemplary encoder 201 or rotary selector/switch, such as a thumbwheel encoder. The first processor 184 also sends outputs to the fob display 172 (e.g., a 120×32 LCD), one or more visual alerts, such as a red backlight 210

(e.g., an alert is present) and a green backlight 212 (e.g., no alert is present) for the display 172, and an alert device 214 (e.g., a suitable audible, visual or vibrating device providing, for example, a sound, tone, buzzer, vibration or flashing light).

The program switch 174 may be, for example, an ESE-24MH1T Panasonic® two-pole detector switch or a Panasonic® EVQ-11U04M one-pole micro-switch. This program switch 174 includes an external pivotable or linear actuator (not shown), which may be toggled in one of two directions (e.g., pivoted clockwise and counter-clockwise; in and out), in order to close one of one or two normally open contacts (not shown). Such a two-pole detector is advantageous in applications in which the fob 154 is swiped to engage one of the network devices 148,150,152 or base station 147 of FIG. 5. Hence, by monitoring one of those contacts, when the fob 154 is swiped in one linear direction, the corresponding contact is momentarily closed, without concern for overtravel of the corresponding engagement surface (not shown). Similarly, by monitoring the other of those contacts, when the fob 154 is swiped in the other linear direction, the corresponding contact is momentarily closed and another suitable action (e.g., a diagnostic function; a suitable action in response to removal of the fob 154; a removal of a component from the network 162; an indication to enter a different configuration or run mode) may be undertaken.

Although a physical switch 174 is disclosed, an "optical" switch (not shown) may be employed, which is activated when the fob 154, or portion thereof, "breaks" an optical beam when mating with another system component. Alternatively, any suitable device or sensor may be employed to detect that the fob 154 has engaged or is suitably proximate to another system component, such as the base station 147 or network devices 148,150,152 of FIG. 5.

The encoder 201 may be, for example, an AEC11BR series encoder marketed by CUI Inc. of Beaverton, Oreg. Although the encoder 201 is shown, any suitable user input device (e.g., a combined rotary switch and pushbutton; touch pad; joystick button) may be employed. Although the alert device 214 is shown, any suitable enunciator (e.g., an audible generator to generate one or more audible tones to alert the user of one or more corresponding status changes; a vibrational generator to alert the user by sense of feel; a visual indicator, such as, for example, an LED indicator to alert the user of a corresponding status change) may be employed. The display 172 preferably provides both streaming alerts to the user as well as optional information messages.

EXAMPLE 17

Figure 7:
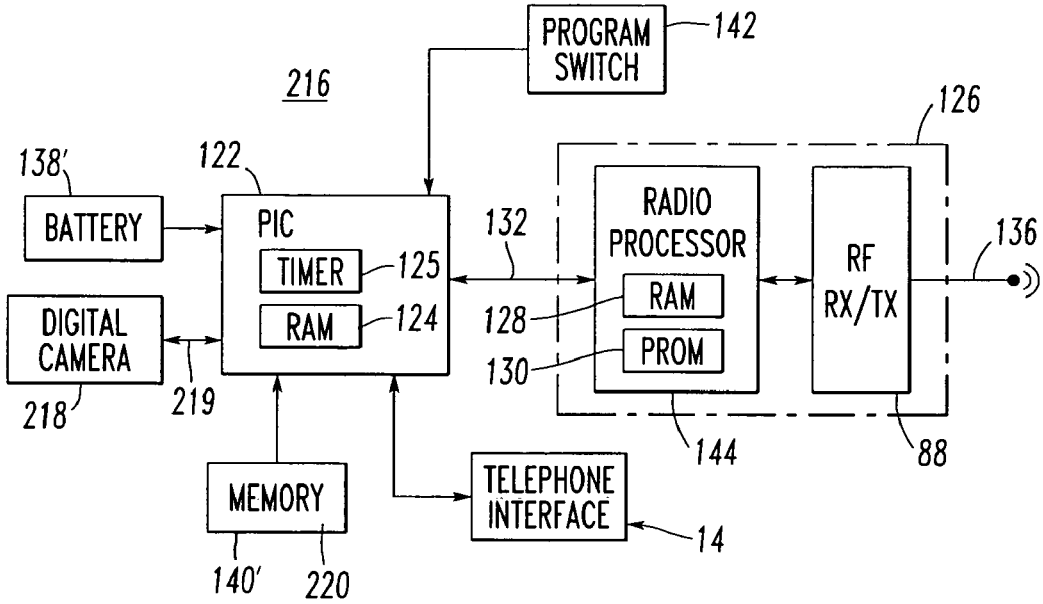
FIG. 7 is a block diagram of another base station including an integral camera.

Referring to FIG. 7, another base station 216 includes an integral digital camera 218 having a suitable interface 219 (e.g., logic level; parallel; serial) to the PIC processor 122. The integral digital camera 218 is adapted to create one or more digital images 220 in the memory 140' (e.g., flash memory) of the PIC processor 122. Preferably, when the digital camera 218 is integral or otherwise permanently electrically or mechanically connected, the base station 216 is portable and includes a suitable power source, such as battery 138'.

EXAMPLE 18

Figure 8:
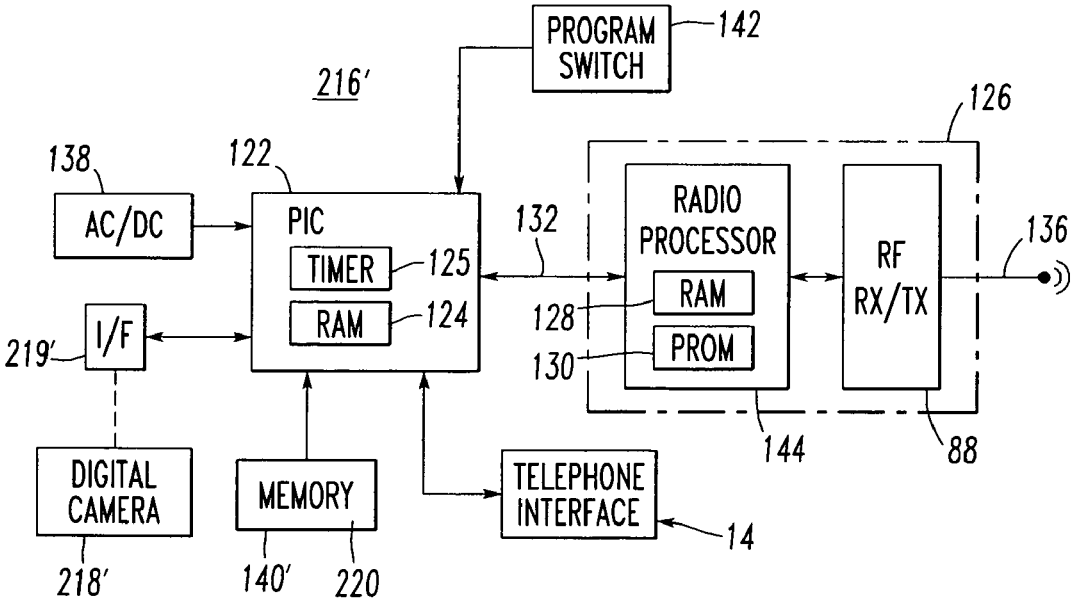
FIG. 8 is a block diagram of another base station communicating with a standalone camera.

FIG. 8 shows another base station 216', which is similar to the base station 216 of FIG. 7, except that the AC/DC power supply 138 is employed and an external digital camera 218' is interfaced through one or more suitable interfaces, such as 219' (e.g., USB; parallel; serial; wired; wireless) to the PIC processor 122. Here, the digital camera 218' is portable and temporarily engages the base station 216', in order to download one or more digital images 220 to the memory 140'. Where the digital camera 218' is wireless, or is temporarily electrically connected or mounted to the base station 216', such base station may be powered from any suitable power source.

EXAMPLE 19

After the user joins the sensors 20,22 (FIG. 1) or the sensor 152 to the network 162 (FIG. 5), the user is prompted by the fob display 172 (FIG. 6) to create corresponding digital images (e.g., a digital picture). For example, using one of the digital cameras 218,218' (FIGS. 7 and 8), the user creates the digital images 220 of the corresponding sensor locations (e.g., a location where the sensor is mounted; the window 21 associated with the window sensor 20; the area 23 associated with the motion sensor 22; a hot water heater (not shown) associated with a water sensor (not shown); a garage door (not shown) associated with a garage door sensor (not shown); an entry door (not shown) associated with a door sensor (not shown)) that will be sensed by the system 146. The user saves the digital images 220 to the base station 147 and employs the fob user input device 201 to associate each digital image with the corresponding sensor state (e.g., window 21 open; motion detected in area 23)). As was discussed above in connection with FIG. 1, when the alert for the event 29A is sent from the base station 10 to the cellular telephone 8, the display 6 thereof shows the predetermined digital image 220 associated with the "activated" sensor 22.

EXAMPLE 20

Alternatively, it will be appreciated that a digital camera, such as 218 (FIG. 7), may be located in a fob, such as 154 (FIG. 5), in a cellular telephone, such as 8 (FIG. 1), in a camera/sensor, such as 24 (FIG. 1), or be a conventional digital camera. Here, where the predetermined digital images are created during system setup, a wide range of camera configurations is possible.

Figure 9A:
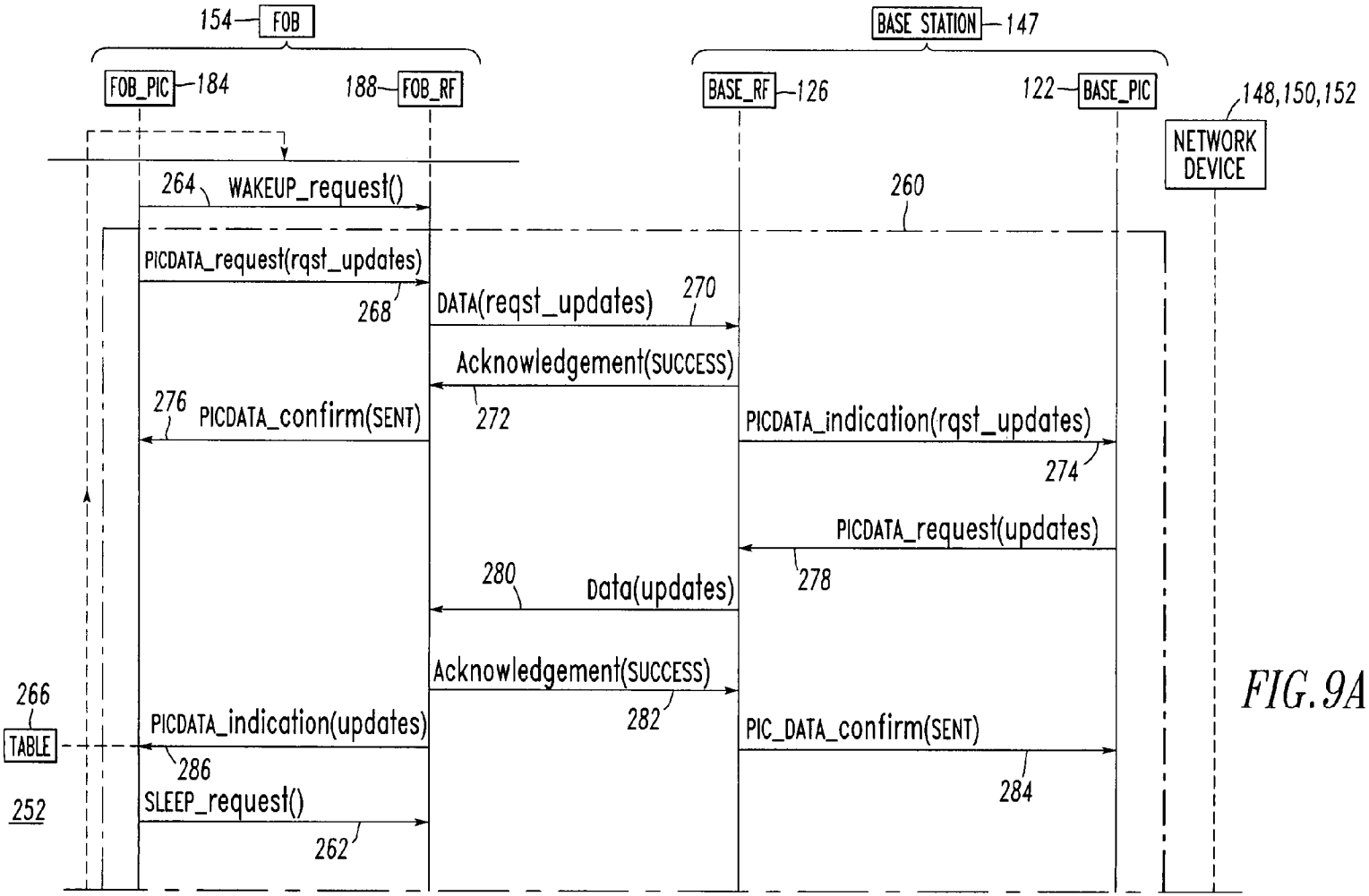
FIGS. 9A-9C are message flow diagrams showing the interaction between the portable fob, the base station and various network devices for monitoring the devices and sending data to the base station of FIG. 5.
Figure 9B:
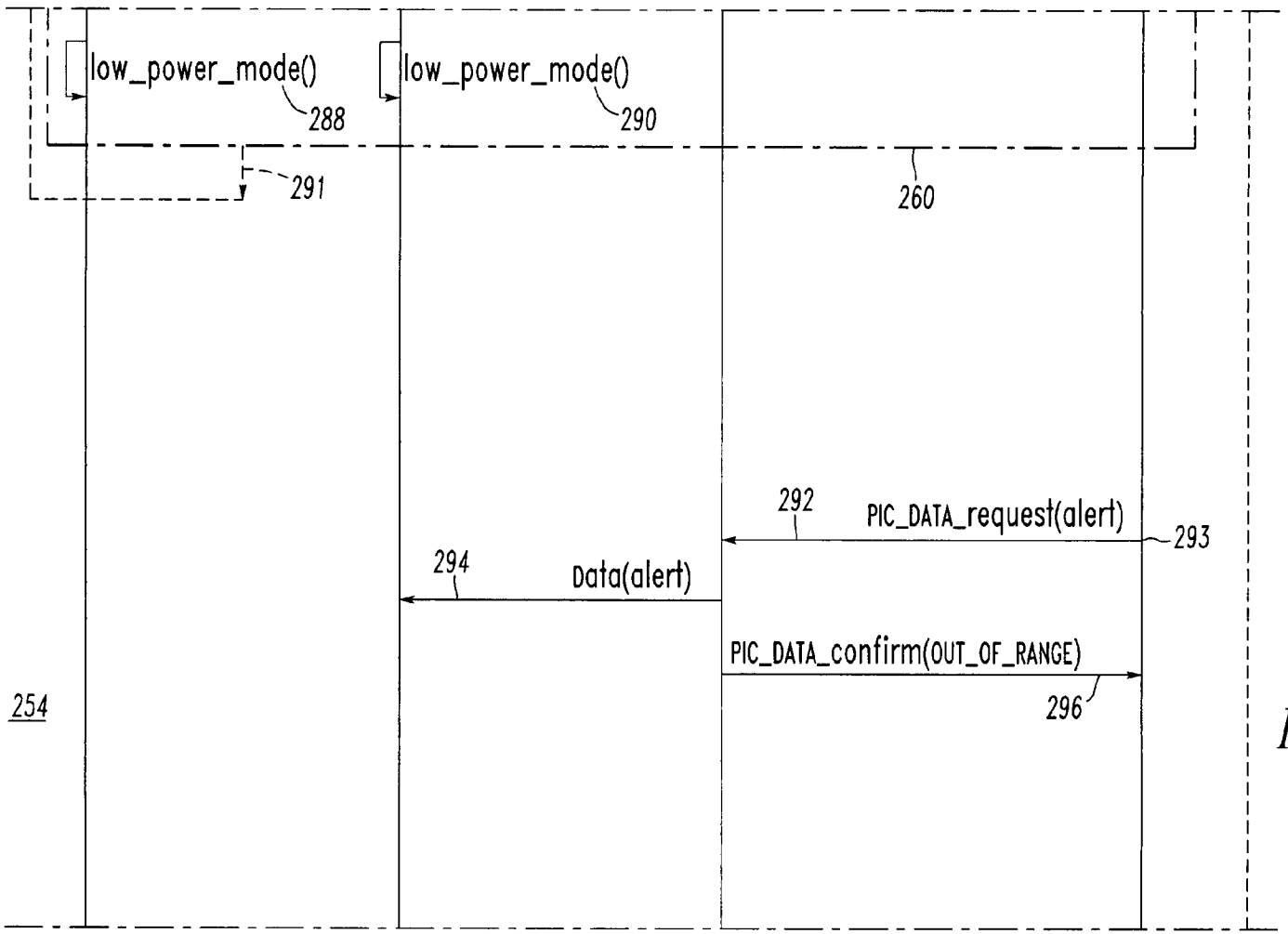
Figure 9C:
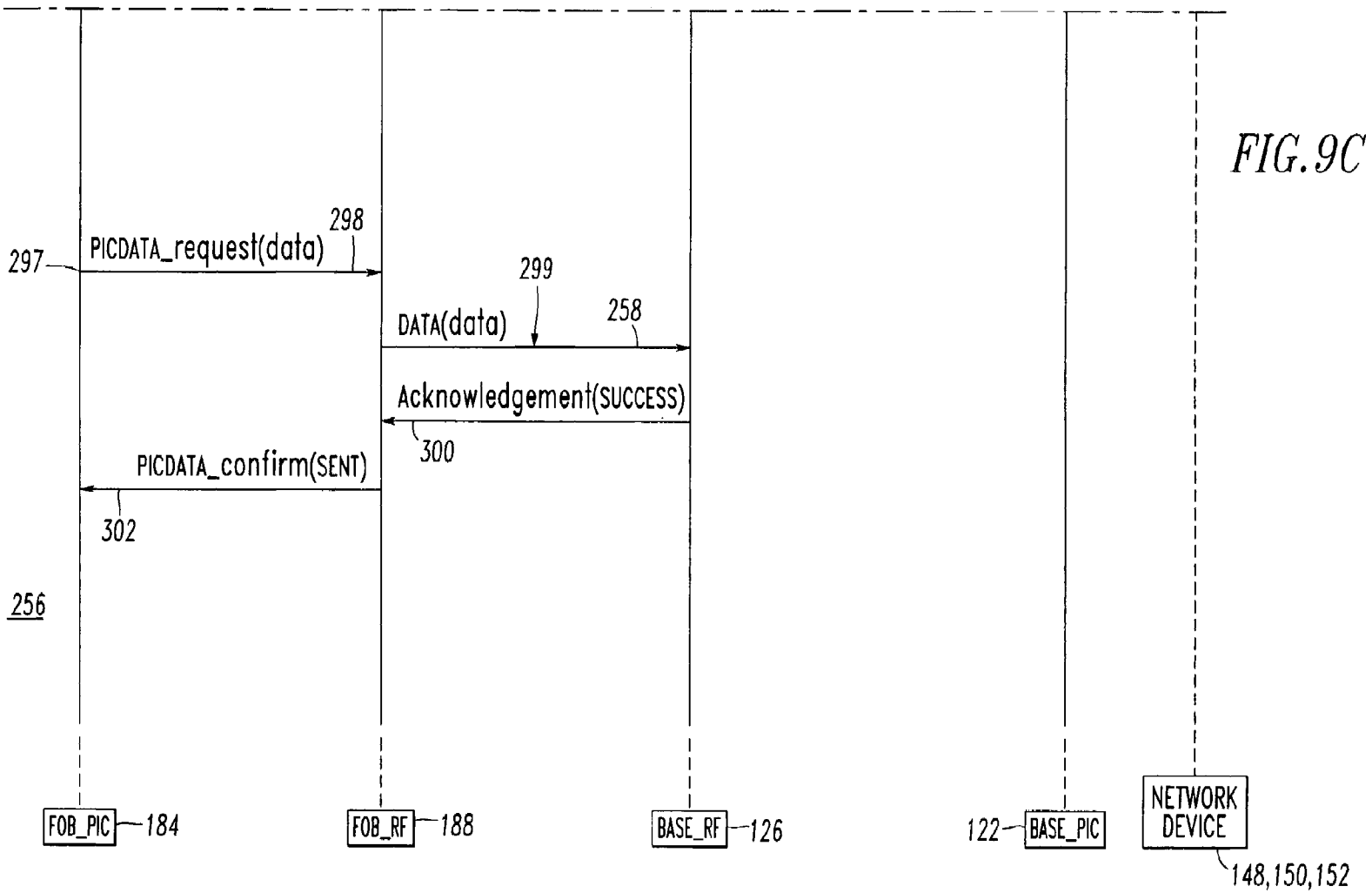

FIGS. 9A-9C are message flow diagrams 252, 254 and 256, respectively, showing the interaction between the portable fob 154 of FIG. 5, the base station 147 (or the base station 10 of FIG. 1) and the network devices 148,150,152 (or the network devices 4,20,22,24 of FIG. 1) for monitoring the network devices and sending data to the base station. FIG. 9A shows that the fob 154 requests and receives information from the base station 147. Preferably, those requests (only one request is shown) are initiated at regular (e.g., periodic) intervals. FIG. 9B shows that the base station 147 may also send a message to the fob 154 in response to a state change of one of the network devices 148,150,152. In this example, the fob 154 is out of range of the base station 147. FIG. 9C shows that the fob 154 sends fob data 258 to the base station 147. As shown in FIGS. 4, 6 and 9A-9C, the base station 147 (which is similar to the base station 10 of FIG. 4) includes both a PIC processor 122 and an RF processor 126, and the fob 154 includes both a PIC processor 184 and an RF processor 188. It will be appreciated, however, that such components may alternatively employ one or more suitable processors.

As shown in FIG. 9A, the fob 154 periodically requests and receives information from the base station 147. At the end of the message sequence 260 (FIGS. 9A-9B), the fob PIC processor 184 sends a SLEEP_request( ) 262 to the fob RF processor 188. Then, after a suitable sleep interval to conserve battery power (e.g., one minute), the fob PIC processor 184 is woken by the fob timer 185 of FIG. 6, and the fob PIC processor 184 sends a WAKEUP_request( ) message 264 to the fob RF processor 188. In turn, the message sequence 260 is executed to refresh the local fob data table 266 with the most recent available information from base station 147 concerning the network devices 148,150,152.

As part of the sequence 260, the fob PIC processor 184 sends a PICDATA_request(rqst_updates) message 268 to the fob RF processor 188, which receives that message 268 and responsively sends a Data(reqst_updates) RF message 270 to the base RF processor 126. Upon receipt of the RF message 270, the base RF processor 126 sends an Acknowledgement (SUCCESS) RF message 272 back to the fob RF processor 188 and sends a PICDATA_indication(rqst_updates) message 274 to the base PIC processor 122. The data requested by this message 274 may include, for example, profile and state information from one or more components, such as the network devices 148,150,152. Here, the fob 154 is requesting an update from the base PIC processor 122 for data from all of the network devices 148,150,152, including any newly added sensor (not shown), in view of that state change (i.e., there is new data from the newly added sensor (not shown)). Responsive to receiving the Acknowledgement(SUCCESS) RF message 272, the fob RF processor 188 sends a PICDATA_confirm(SENT) message 276 to the fob PIC processor 184. Responsive to receiving the PICDATA_indication(rqst_updates) message 274, the base PIC processor 122 sends a PICDATA_request(updates) message 278 to the base RF processor 126, which receives that message 278 and responsively sends a Data(updates) RF message 280 to the fob RF processor 188.

After receiving the Data(updates) RF message 280, the fob RF processor 188 sends an Acknowledgement(SUCCESS) RF message 282 back to the base RF processor 126 and sends a PICDATA_indication(updates) message 286, including the requested sensor update data, to the fob PIC processor 184, which updates its local data table 266. Then, if there is no activity of the fob user input device (e.g., thumbwheel) 201, or if no alert is received from the base station 147, then the fob PIC processor 184 sends a SLEEP_request( ) message 262 to the fob RF processor 188 and both fob processors 184,188 enter a low_power_mode( ) 288,290, respectively (FIG. 9B).

After receiving the Acknowledgement(SUCCESS) RF message 282, the base RF processor 126 sends a PIC_DATA_confirm(SENT) message 284 back to the base PIC processor 122. Following the message sequence 260, the fob timer 185 (FIG. 6) awakens the fob PIC processor 184, at 291 (FIG. 9B), which sends the message 264 to the fob RF processor 188, in order to periodically repeat the message sequence 260.

FIG. 9B shows an alert message sequence from the base station 147 to the fob 154, in which the fob 154 is out of range of the base station 147. First, at 293, the base station PIC processor 122 sends a PIC_DATA_request(alert) message 292 to the base station RF processor 126. In response, that processor 126 sends a Data(alert) RF message 294 to the fob RF processor 188. In this example, any RF message sent by the base station 147 while the fob 154 is out of range (or in low power mode) will be lost. After a suitable time out period, the base station RF processor 126 detects the non-response by the fob 154 and responsively sends a PIC_DATA_confirm(OUT_OF_RANGE) message 296 back to the base station PIC processor 122.

In FIG. 9C, at 297, the fob PIC processor 184 sends a PICDATA_request(data) message 298 to the fob RF processor 188. Next, the fob RF processor 188 sends a Data(data) RF message 299 including the fob data 258 to the base station RF processor 126. In response, the base station RF processor 126 sends an Acknowledgement(SUCCESS) RF message 300 to the fob RF processor 188. Finally, the fob RF processor 188 sends a PICDATA_confirm(SENT) message 302 to the fob PIC processor 184.

Figures 10A, 10B:
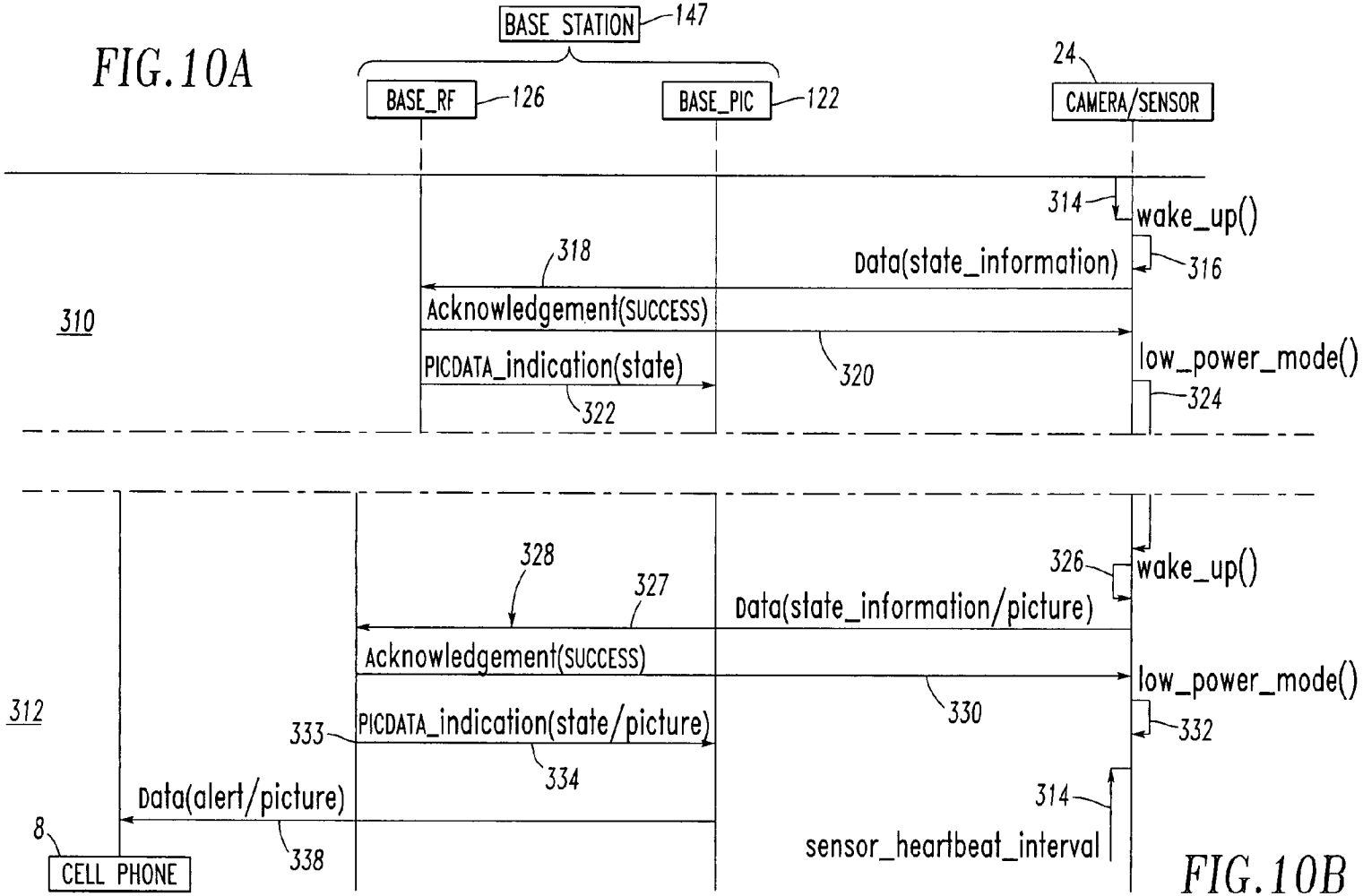
FIGS. 10A-10B are message flow diagrams showing the interaction between the wireless digital camera/sensor of FIG. 3 and the base station of FIG. 4 for monitoring that camera/sensor at a cellular telephone.

FIGS. 10A-10B are message flow diagrams 310,312 showing the interaction between a camera or sensor, such as the wireless digital camera/sensor 24 of FIG. 3, and the base station 147 of FIG. 5 (which, again, is similar to the base station 10 of FIG. 4) for monitoring that camera/sensor 24. FIG. 10A shows that the camera/sensor 24 sends state information to the base station 147 at regular (e.g., periodic) intervals. FIG. 10B shows that the camera/sensor 24 also sends state information to the base station 147 in response to sensor state changes. A sensor timer 98 of FIG. 3 preferably establishes the regular interval, sensor_heartbeat_interval 314 of FIGS. 10A-10B (e.g., without limitation, once per minute; once per hour; once per day; any suitable time period), for that particular sensor. It will be appreciated that the regular intervals for the various network devices 4,20,22 (FIG. 1) and 148,150,152 (FIG. 5) may be the same or may be different depending upon the desired update interval for each particular device.

In FIG. 10A, after the expiration of the sensor_heartbeat_interval 314, the sensor, such as 24, wakes up (wake_up( )) at 316. Next, the sensor 24 sends a Data(state_information) RF message 318 to the base station RF processor 126, and that RF processor 126 responsively sends an Acknowledgement (SUCCESS) RF message 320 back to the sensor 24. Responsive to receiving that message 320, the sensor 24 enters a low_power_mode( ) 324 (e.g., in order to conserve power of the sensor battery 90 of FIG. 3). Also, responsive to sending that message 320, the base station RF processor 126 sends a PICDATA_indication(state) message 322 to the base station PIC processor 122. Both of the Data(state_information) RF message 318 and the PICDATA_indication(state) message 322 convey the state of the sensor 24 (e.g., motion detected; sensor battery OK/low).

The low_power_mode( ) 324 is maintained until one of two events occurs. As was previously discussed, after the expiration of the sensor_heartbeat_interval 314, the sensor 24 wakes up at 316. Alternatively, as shown in FIG. 10B, the sensor 24 wakes up (wake_up( ) 326) in response to a state change (e.g., motion detected) and responsively creates a digital image 327 by employing the digital camera 110 of FIG. 3. Next, the sensor 24 sends a Data(state_information/picture) RF message 328 including the digital image 327 to the base station RF processor 126, and that RF processor 126 responsively sends an Acknowledgement(SUCCESS) RF message 330 back to the sensor 24. Responsive to receiving that message 330, the sensor 24 enters a low_power_mode( ) 332. After the expiration of the sensor_heartbeat_interval 314, the sensor 24 wakes up at 316 of FIG. 10A. Next, at 333, the base station RF processor 126 responsively sends a PICDATA_indication(state/picture) message 334 to the base station PIC processor 122. Both of the Data(state_information/picture) RF message 328 and the PICDATA_indication(state/picture) message 334 convey the state of the sensor 24 and the digital image 327. Responsive to receiving that message 334, the base station PIC processor 122 sends a Data(alert/picture) message 338, via the telephone interface 14 (FIG. 4), including the digital image 327, to the cellular telephone 8 of FIG. 1. Such an alert is sent whenever there is any sensor state change.

EXAMPLE 21

As was discussed above in connection with FIG. 10B (camera physically paired with sensor), and as will be discussed below in connection with FIG. 11 (camera logically paired with sensor), during setup of the home monitoring systems 2 (FIG. 1) or 146 (FIG. 5), a camera, such as 42,4 or 148,150, is "paired" (e.g., physically in the case of camera sensor 24; logically in the case of cameras 4,148,150) with a sensor, such as 26,22 or 152, respectively, in order to provide a "live" snapshot digital image whenever an event (e.g., window sensor 20 detects that the window 21 is open; motion sensor 22 detects an animal in the area 23) "trips" the sensor. The camera/sensor 24 permits a user to capture a live digital image when an event occurs. This also permits a number of cameras 4, 148,150 to be located around an area or residence, with the digital cameras being triggered from one or more different sensor sources. In this manner, the base station 10 and, thus, cellular telephone 8 can receive the corresponding digital image(s) at the time of the event.

EXAMPLE 22

Figure 11:
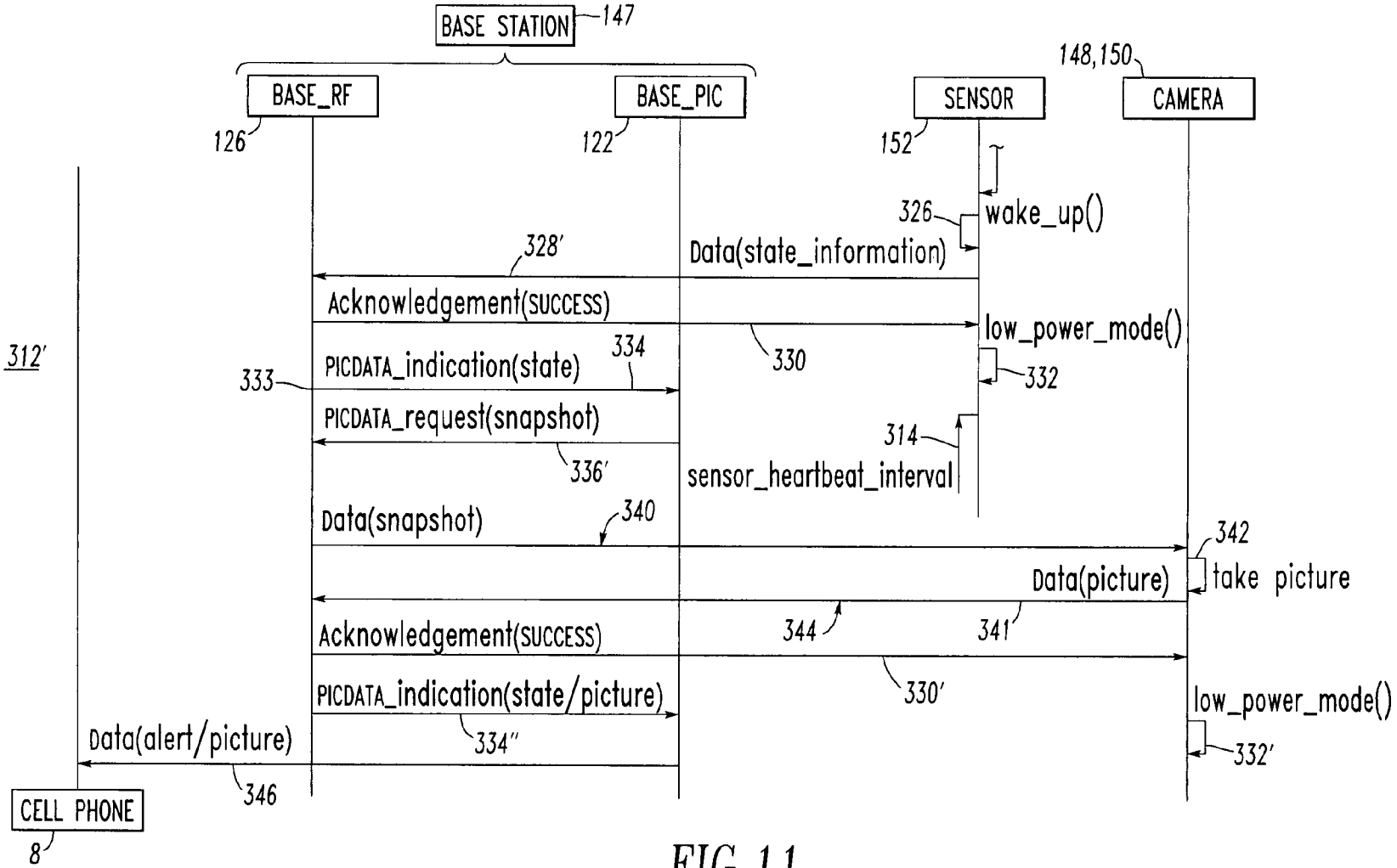
FIG. 11 is a message flow diagram showing the interaction between a cellular telephone and the base station, the sensor and the wireless digital camera of FIG. 1.

FIG. 11 is a message flow diagram 312' showing the interaction between the cellular telephone 8 of FIG. 1, one of the sensors 152 (or 20,22 of FIG. 1), the base station 147 (or the base station 10), and the wireless digital cameras 148,150 (or the camera 4 of FIG. 1). Here, the sensor 152 does not provide a digital image with the Data(state_information) RF message 328'. Responsive to the PICDATA_request(snapshot) message 336', the base station RF processor 126 sends a DATA (snapshot) RF message 340 to the corresponding camera(s) 148,150. In turn, the corresponding camera responsively creates a digital image 341 at 342. Next, the corresponding camera sends a DATA(picture) RF message 344 including the digital image 341 to the base station RF processor 126. Then, the RF processor 126 responsively sends an Acknowledgement(SUCCESS) RF message 330' back to the corresponding camera. Responsive to receiving that message 330', the camera preferably enters a low_power_mode( ) 332'. Next, the base station RF processor 126 sends a PICDATA_indication (state/picture) message 334" to the base station PIC processor 122. The Data(state_information) RF message 328' conveys the state of the sensor 152, and the PICDATA_indication (state/picture) message 334" conveys that sensor state and the digital image 341. Responsive to receiving that message 334", the base station PIC processor 122 sends a Data(alert/picture) message 346, via the telephone interface 14 (FIG. 4), including the digital image 341, to the cellular telephone 8 of FIG. 1. Such an alert is sent whenever there is any sensor state change.

The advantage of logical pairing is that the wireless digital cameras 4,148,150 can be mounted in a location, possibly physically separate, but otherwise associated with one or more sensors, such as 20,22,152 (e.g., on a wall opposite, for example, one or more window, door and/or motion sensors).

EXAMPLE 23

Figure 12:
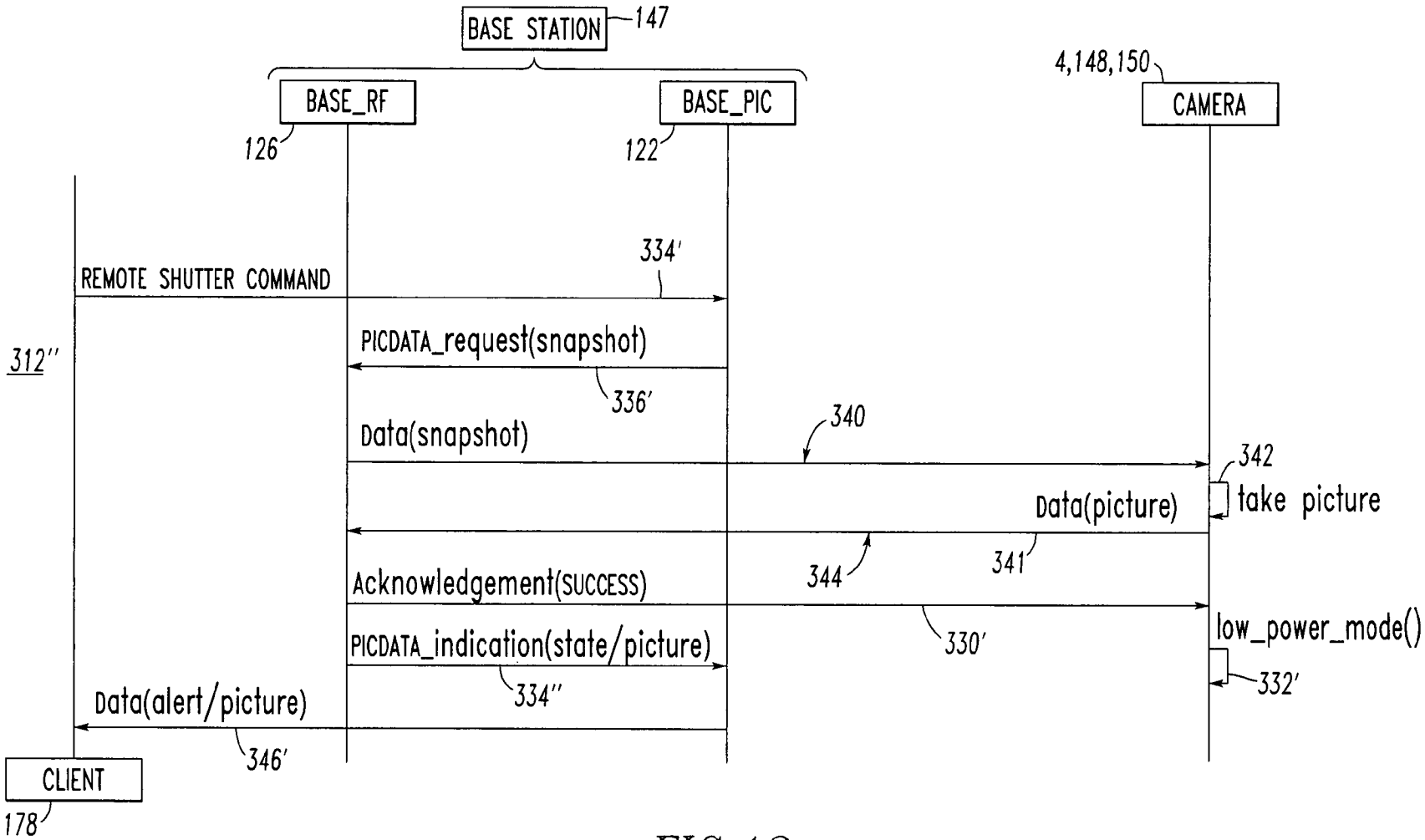
FIG. 12 is a message flow diagram showing the interaction between a remote client, the base station and the wireless digital camera of FIG. 1.

FIG. 12 shows a message flow diagram 312", which is somewhat similar to the diagram 312' of FIG. 11, including messages between the remote client 178 of FIG. 5, the base station 147 and one or more of the wireless digital cameras 148,150 (or camera 4 of FIG. 1). Here, however, the remote client 178, instead of the sensors 20,22,152, initiates the creation of the digital image by the selected one or more of the wireless digital cameras 148,150. The two differences are that the remote client 178 initiates a REMOTE SHUTTER COMMAND message 334' (through the Internet 160 and communication link 158 of FIG. 5) in place of the PICDATA_indication(state) message 334 of FIG. 11. Also, the Data(alert/picture) message 346' of FIG. 12 is directed back to the requester, which in this example is the remote client 178.

EXAMPLE 24

It will be appreciated, however, that any suitable client, such as the cellular telephone 8 of FIG. 1, may initiate one or more snapshot requests and receive the corresponding one or more digital images from one or more cameras. This permits, for example, the cellular telephone user to request and obtain a new and refreshed digital image.

EXAMPLE 25

Provisions may be made to store and selectively forward the digital image from the base station 10,147 for possible future reference (e.g., insurance purposes; visual verification to police of burglary; reprimands to children or neighbors; status of a disabled or elderly person to a health care or elder care service provider). Here, the user determines the appropriate action based on the visual information being displayed.

EXAMPLE 26

Figure 13:
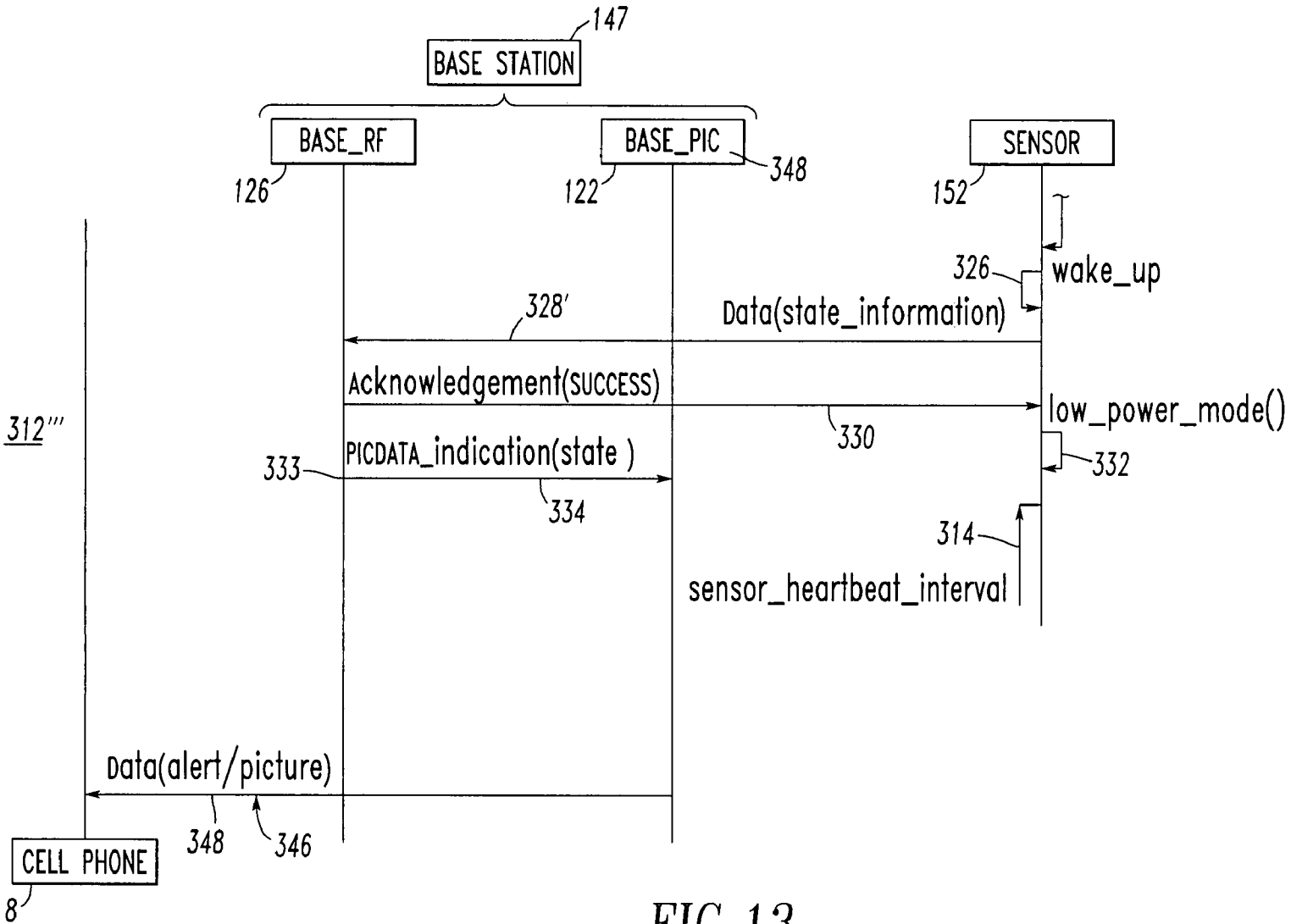
FIG. 13 is a message flow diagram showing the interaction between a cellular telephone and the base station and the sensor of FIG. 1.

FIG. 13 is a message flow diagram 312'", which is somewhat similar to the message flow diagram 312' of FIG. 11, showing the interaction between the cellular telephone 8 of FIG. 1, one of the sensors 152 (or 20,22 of FIG. 1), and the base station 147 (or the base station 10). Here, a camera, such as 148 of FIG. 5, does not provide a digital image. Instead, a digital image 348 (e.g., of the "activated" sensor 152 in its location) is predetermined in the memory of the base station 147.

Responsive to receiving the PICDATA_indication(state) message 334 by the base station PIC processor 122, it associates the sensor 152 with the predetermined digital image 348. In turn, the base station PIC processor 122 sends a Data(alert/picture) message 346 including the predetermined digital image 348 to the cellular telephone 8 of FIG. 1.

While for clarity of disclosure reference has been made herein to the exemplary displays 6,172 for displaying digital images or home system information, it will be appreciated that such images or information may be stored, printed on hard copy, be computer modified, or be combined with other data. All such processing shall be deemed to fall within the terms "display" or "displaying" as employed herein.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A system for a structure, said system for a structure comprising:

a server including a first communication port, a second communication port and a memory having at least one digital image;

a plurality of first devices, at least one of said first devices comprising a sensor adapted to detect an event, and a first communication port adapted to send the detected event to the first communication port of said server; and a second device including a second communication port and a display, wherein the second communication port of said server is adapted to send one of said at least one digital image to the second communication port of said second device responsive to receipt of said detected event at the first communication port of said server, and wherein said second device is adapted to display said one of said at least one digital image on said display responsive to receipt thereof at the second communication port of said second device.

2. The system for a structure of claim 1 wherein said second device is a cellular telephone; and wherein said second communication port of said second device is an antenna.

3. The system for a structure of claim 1 wherein said second device is a client device; and wherein said second communication port of said second device is a global communication network port.

4. The system for a structure of claim 1 wherein said server includes an integral digital camera adapted to create said at least one digital image in the memory of said server.

5. The system for a structure of claim 1 wherein said server includes an interface adapted to communicate with a digital camera, receive said at least one digital image from said digital camera, and store said at least one digital image from said digital camera in the memory of said server.

6. The system for a structure of claim 5 wherein said interface is structured to to temporarily engage said digital camera.

7. The system for a structure of claim 5 wherein said digital camera includes a wireless port; and wherein said interface is adapted to communicate with the wireless port of said digital camera.

8. The system for a structure of claim 1 wherein said one of said at least one digital image is a predetermined digital image in the memory of said server prior to receipt of said detected event at the first communication port of said server.

9. The system for a structure of claim 1 wherein said one of said at least one digital image is communicated to the first communication port of said server with said detected event.

10. The system for a structure of claim 1 wherein the sensor of said at least one of said first devices is a motion detector adapted to detect motion as said event.

11. The system for a structure of claim 1 wherein some of said devices include a plurality of sensors, each one of said sensors sensing information and including a corresponding communication port, which sends said sensed information to the first communication port of said server.

12. A system for a structure, said system for a structure comprising:

a server including a first communication port, a second communication port and a memory having at least one digital image;

a plurality of first devices, at least one of said first devices comprising a sensor adapted to detect an event, and a first communication port adapted to send the detected event to the first communication port of said server; and a second device including a second communication port and a display, wherein the second communication port of said server is structured to send one of said at least one digital image to the second communication port of said second device responsive to receipt of said detected event at the first communication port of said server, wherein said second device is adapted to display said one of said at least one digital image on said display responsive to receipt thereof at the second communication port of said second device, wherein said one of said at least one digital image is a predetermined digital image in the memory of said server; and wherein said server is adapted to receive a message from said at least one of said first devices as said detected event and to associate said message with said predetermined digital image.

13. A system for a structure, said system for a structure comprising:

a server including a first communication port, a second communication port and a memory having at least one digital image;

a plurality of first devices, at least one of said first devices comprising a sensor adapted to detect an event, and a first communication port adapted to send the detected event to the first communication port of said server; and a second device including a second communication port and a display, wherein the second communication port of said server is structured to send one of said at least one digital image to the second communication port of said second device responsive to receipt of said detected event at the first communication port of said server, wherein said second device is adapted to display said one of said at least one digital image on said display responsive to receipt thereof at the second communication port of said second device, wherein said server is adapted to receive a message and a corresponding digital image from said at least one of said first devices at the first communication port of said server, and to store said corresponding digital image as said one of said at least one digital image in the memory of said server.

14. A system for a structure, said system for a structure comprising:

a server including a first communication port, a second communication port and a memory having at least one digital image;

a plurality of first devices, at least one of said first devices comprising a sensor adapted to detect an event, and a first communication port adapted to send the detected event to the first communication port of said server; and a second device including a second communication port and a display, wherein the second communication port of said server is structured to send one of said at least one digital image to the second communication port of said second device responsive to receipt of said detected event at the first communication port of said server, wherein said second device is adapted to display said one of said at least one digital image on said display responsive to receipt thereof at the second communication port of said second device, wherein said second device is adapted to send a request message from the second communication port thereof to the second communication port of said server; wherein said server is adapted to receive said request message from the second communication port thereof and to send another request message to the first communication port of said at least one of said first devices; wherein said at least one of said first devices is a digital camera device comprising said sensor, which is adapted to detect receipt of said another request message as said event, a digital camera adapted to create a corresponding digital image responsive to said event, and said first communication port of said at least one of said first devices being adapted to send said corresponding digital image as said detected event to the first communication port of said server; wherein said server is adapted to stored said corresponding digital image in the memory of said server and to send said corresponding digital image from the second communication port thereof to the second communication port of said second device; and wherein said second device is adapted to display said corresponding digital image on said display responsive to receipt thereof at the second communication port of said second device.

15. The system for a structure of claim 14 wherein said second device is adapted to send a plurality of request messages from the second communication port thereof to the second communication port of said server; and wherein said second device is further adapted to display a plurality of corresponding digital images on said display responsive to receipt thereof at the second communication port of said second device.

16. A system for a structure, said system for a structure comprising:

a server including a first communication port, a second communication port and a memory having at least one digital image;

a plurality of first devices, at least one of said first devices comprising a sensor adapted to detect an event, and a first communication port adapted to send the detected event to the first communication port of said server; and a second device including a second communication port and a display, wherein the second communication port of said server is structured to send one of said at least one digital image to the second communication port of said second device responsive to receipt of said detected event at the first communication port of said server, wherein said second device is adapted to display said one of said at least one digital image on said display responsive to receipt thereof at the second communication port of said second device, wherein said at least one of said first devices further includes a digital camera operatively associated with said sensor; wherein said sensor is adapted to detect said event and responsively trigger said digital camera; and wherein said digital camera, responsive to said trigger, is adapted to create a digital image and communicate said created digital image to the first communication port of said server with detected event.

17. A system for a structure, said system for a structure comprising:

a server including a first communication port, a second communication port and a memory having at least one digital image;

a plurality of first devices, at least one of said first devices comprising a sensor adapted to detect an event, and a first communication port adapted to send the detected event to the first communication port of said server; and a second device including a second communication port and a display, wherein the second communication port of said server is structured to send one of said at least one digital image to the second communication port of said second device responsive to receipt of said detected event at the first communication port of said server, wherein said second device is adapted to display said one of said at least one digital image on said display responsive to receipt thereof at the second communication port of said second device, wherein another one of said first devices is a digital camera including a corresponding first communication port; wherein said second sensor is adapted to detect a said event and responsively send the detected event to the first communication port of said server; wherein said server is adapted to receive said detected event and send a snapshot request to the corresponding first communication port of said digital camera; and wherein said digital camera, responsive to receiving said snapshot request, is adapted to create a second digital image and communicate said created digital image to the first communication port of said server.

18. A system for a structure, said system for a structure comprising:

a server including a first communication port, a second communication port and a memory having at least one digital image;

a plurality of first devices, at least one of said first devices comprising a sensor adapted to detect an event, and a first communication port adapted to send the detected event to the first communication port of said server; and a second device including a second communication port and a display, wherein the second communication port of said server is structured to send one of said at least one digital image to the second communication port of said second device responsive to receipt of said detected event at the first communication port of said server, wherein said second device is adapted to display said one of said at least one digital image on said display responsive to receipt thereof at the second communication port of said second device, wherein said sensor is a first sensor; wherein said event is a first event; wherein said digital image is a first digital image; wherein another one of said first devices is a second sensor including a corresponding first communication port; wherein a further one of said first devices is a digital camera including a corresponding first communication port; wherein said second sensor is adapted to detect a second event and responsively send the detected second event to the first communication port of said server; and wherein said server is adapted to receive said detected second event and send a snapshot request to the corresponding first communication port of said digital camera; and wherein said digital camera, responsive to receiving said snapshot request, is adapted to create a second digital image and communicate said created digital image to the first communication port of said server.

19. A system for a structure, said system for a structure comprising:

a server including a first communication port, a second communication port and a memory having at least one digital image;

a plurality of first devices, at least one of said first devices comprising a sensor adapted to detect an event, and a first communication port adapted to send the detected event to the first communication port of said server; and a second device including a second communication port and a display, wherein the second communication port of said server is structured to send one of said at least one digital image to the second communication port of said second device responsive to receipt of said detected event at the first communication port of said server, wherein said second device is adapted to display said one of said at least one digital image on said display responsive to receipt thereof at the second communication port of said second device, wherein said at least one of said first devices further includes a plurality of digital cameras operatively associated with said sensor; wherein said sensor is adapted to detect said event and responsively trigger said digital cameras; wherein each of said digital cameras, responsive to said trigger, is adapted to create a corresponding digital image and to communicate said corresponding digital image to the first communication port of said server; and wherein said server is adapted to receive each of said corresponding digital images at the first communication port of said server, and to store said corresponding digital images in the memory of said server.

20. A system for a structure, said system for a structure comprising:

a server including a first communication port, a second communication port and a memory having at least one digital image;

a plurality of first devices, at least one of said first devices comprising a sensor adapted to detect an event, and a first communication port adapted to send the detected event to the first communication port of said server; and a second device including a second communication port and a display, wherein the second communication port of said server is structured to send one of said at least one digital image to the second communication port of said second device responsive to receipt of said detected event at the first communication port of said server, wherein said second device is adapted to display said one of said at least one digital image on said display responsive to receipt thereof at the second communication port of said second device, wherein some of said devices include a plurality of sensors, each one of said sensors sensing information and including a corresponding communication port, which sends said sensed information to the first communication port of said server, wherein one of said devices is a portable fob including a corresponding communication port and a display; and wherein said server is adapted to send said sensed information for at least one of said sensors from the first communication port of said server to the corresponding communication port of said portable fob, said portable fob being adapted to display said sensed information for at least one of said sensors at the display of said portable fob.

21. A method of displaying a digital image responsive to an event of a system for a structure, said method comprising:

employing a server including a memory having at least one digital image;

employing a plurality of first devices associated with said server;

detecting an event at one of said first devices and sending the detected event to said server;

responsive to said detecting an event, sending one of said at least one digital image to a second device; and receiving said on of said at least one digital image at the second device and responsively displaying said one of said at least one digital image on a display of said second device, in order to represent said detected event.

22. The method of claim 21 further comprising employing as said at least one digital image a predetermined digital image in the memory of said server; and receiving a message from one of said first devices as said detecting an event and associating said received message with said predetermined digital image.

23. The method of claim 21 further comprising employing as one of said first devices a digital camera;

employing a sensor operatively associated with said digital camera;

detecting said event with said sensor and responsively triggering said digital camera to create a digital image; and communicating said created digital image to said server with said detected event.

24. A method of displaying a digital image responsive to an event of a system for a structure, said method comprising:

employing a server including a memory having at least one digital image;

employing a plurality of first devices associated with said server;

detecting an event at one of said first devices and sending the detected event to said server;

responsively sending one of said at least one digital image to a second device;

responsively displaying said one of said at least one digital image on a display of said second device, in order to represent said detected event;

employing as one of said first devices a digital camera including a communication port;

employing as another one of said first devices a sensor including a communication port;

detecting said event with said sensor and responsively sending the detected event from the communication port of said sensor to said server;

receiving said detected event at said server and responsively sending a snapshot request to the communication port of said digital camera;

receiving the snapshot request at the communication port of said digital camera and responsively creating a digital image; and sending said created digital image from the communication port of said digital camera to said server.

25. The method of claim 24 further comprising employing as another one of said first devices another digital camera including a communication port;

sending another snapshot request to the communication port of said another digital camera;

receiving the snapshot request at the communication port of said another digital camera and responsively creating another digital image; and sending said created another digital image from the communication port of said another digital camera to said server.

* * * * *